US005913381A

United States Patent [19]

D'Armond, Jr.

[11] Patent Number: 5,913,381

[45] Date of Patent: Jun. 22, 1999

[54] FRICTION SAWHORSE BRACKET

[76] Inventor: S. Adrian D'Armond, Jr., 19547 Greenwell Springs Rd., Greenwell Springs, La. 70739

[21] Appl. No.: 08/826,708

[22] Filed: Apr. 7, 1997

[51] Int. Cl.[6] ..... E04G 1/00

[52] U.S. Cl. ..... 182/186.3; 182/186.5

[58] Field of Search ..... 182/181.1, 186.3, 182/186.4, 186.5, 224

[56] References Cited

U.S. PATENT DOCUMENTS

| | | | |
|---|---|---|---|
| 184,957 | 12/1876 | Doeg . | |
| 302,945 | 8/1884 | Sargent | 182/186.3 |
| 617,463 | 1/1899 | Dotts . | |
| 872,722 | 12/1907 | Fravel . | |
| 996,524 | 6/1911 | Raudabaugh . | |
| 1,542,048 | 6/1925 | Forester . | |
| 1,838,151 | 12/1931 | Penote . | |
| 1,953,012 | 3/1934 | Gerrard | 182/186.3 |
| 2,096,668 | 10/1937 | Brown | 304/5 |
| 2,981,366 | 4/1961 | Gutting | 182/186.3 |
| 4,298,095 | 11/1981 | Jackson et al. | 182/184 |
| 4,308,934 | 1/1982 | Jackson et al. | 182/184 |
| 4,890,952 | 1/1990 | Jones | 403/172 |
| 5,377,780 | 1/1995 | Dunaway | 182/186.3 |

*Primary Examiner*—Alvin C. Chin-Shue
*Attorney, Agent, or Firm*—Roy, Kiesel & Tucker

[57] ABSTRACT

The present invention relates to carpentry devices such as sawhorses. More particularly, the present invention relates to brackets which hold the boards forming the legs and cross piece of the sawhorse together in the typical sawhorse configuration.

4 Claims, 2 Drawing Sheets

FRICTION SAWHORSE BRACKET

TECHNICAL FIELD OF THE INVENTION

The present invention relates to carpentry devices such as sawhorses. More particularly, the present invention relates to brackets which hold the boards forming the legs and cross piece of the sawhorse together in the typical sawhorse configuration.

Sawhorses are one of the most commonly used devices in carpentry, painting, and any other activity which requires an inexpensive and expedient manner of creating an elevated surface on which to work. Sawhorses typically are made up of a horizontal cross piece with two inclined legs at each end of the cross piece. For simplicity, the cross piece and legs can be generally referred to as sawhorse members. The stability and usefulness of the sawhorse is most often determined by the manner in which the cross piece is connected to the legs. This connection should be as rigid as possible to give the sawhorse greater stability. Also the connection should allow the sawhorse to be quickly and easily assembled and should facilitate easy replacement of sawhorse members as they become damaged.

BACKGROUND OF THE INVENTION

The prior art has typically attempted to carried out this connection with various types of brackets. U.S. Pat. No. 5,377,780 ('780 patent) discloses a unitary bracket having multiple flanges between which the sawhorse members will be positioned. The flanges have apertures such that holes may be drilled through the sawhorse members and bolts placed through the flange and sawhorse members. The bracket disclosed in the '780 patent illustrates a comparatively complex shape requiring a more complex manufacturing process and requiring a relatively large amount of metal to manufacture. Since this bracket is one piece, the distance between the flanges is fixed and the bracket can only accommodate a board of a single predetermined thickness. Also because the flanges are fixed, the sawhorse member is retained primarily by the bolts rather than frictional force between the flanges and sawhorse member. Furthermore, constructing a sawhorse with this bracket is unduly time consuming since holes must be drilled in the sawhorse members at each point they are connected to the bracket. When the sawhorse members deteriorate or become damaged, replacement requires that the bolts be completely removed from the bracket and the construction process repeated with new sawhorse members.

U.S. Pat. Nos. 617,463 (the '463 patent) and 4,890,952 (the '952 patent) disclose brackets which are connected to sawhorse members without apertures being drilled in the members. However, these brackets substantially enclose the sawhorse members and therefore accommodate only one member (i.e. board) size. The '952 patent does not grip the leg members and apparently relies on gravity to maintain the sawhorse legs in the proper position. The '463 patent employs an involved wedging system at the top of the cross piece and therefore limits not only the size of the legs, but also the size of the cross piece. What is needed in the art is a sawhorse bracket that overcomes the disadvantages discussed above by relying on frictional forces to grip the sawhorse members while not requiring apertures to be formed through the sawhorse members.

OBJECTS AND SUMMARY OF INVENTION

It is therefore an object of the present invention to provide a sawhorse bracket which grips the sawhorse members through frictional forces.

It is another object to provide a sawhorse bracket which is simpler and more economical to produced than known in the art.

It is a further object to provide a sawhorse bracket which allows quicker and easier assembly of the sawhorse.

It is a further object to provide a sawhorse bracket that does not require bolts or nails be passed through the sawhorse members when assembling the sawhorse.

It is still another object to provide a sawhorse bracket that can grip and form the sawhorse from sawhorse members of various sizes.

DETAILED DESCRIPTION

Figure 1:
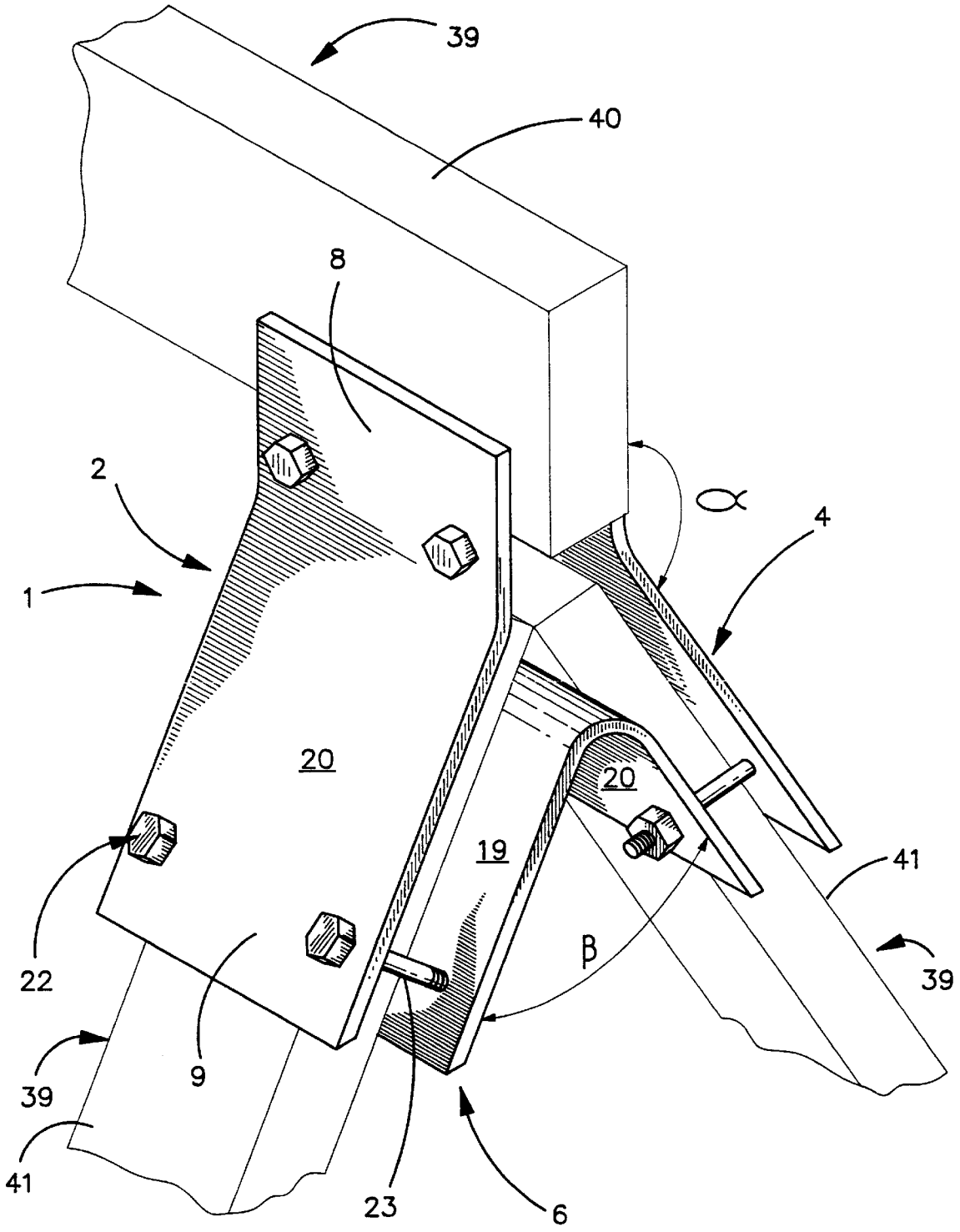
FIG. 1 is a perspective view of the present invention mounted on sawhorse members.
Figure 2:
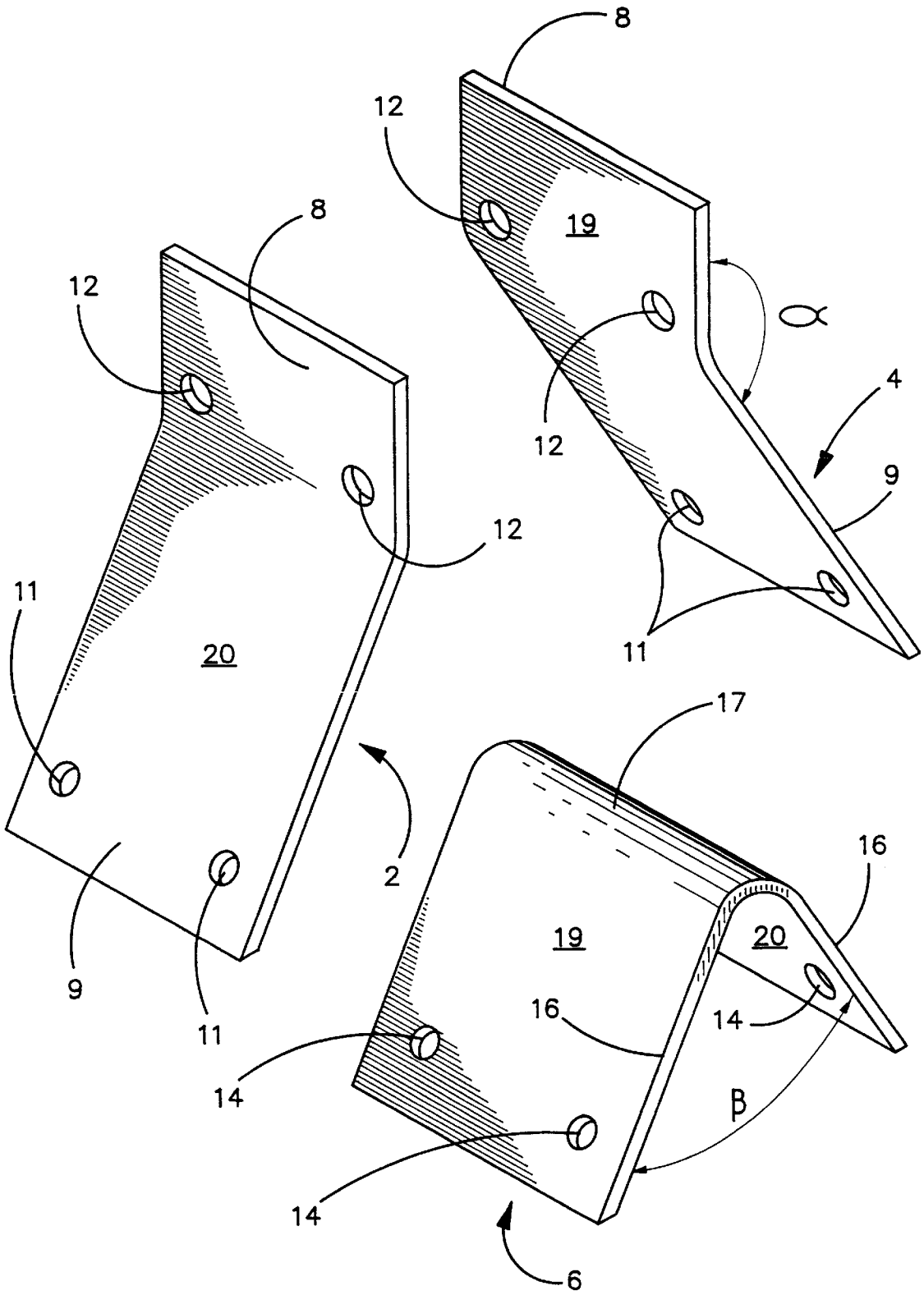
FIG. 2 is an exploded view illustrating various elements of the present invention.

FIG. 1 illustrates how sawhorse bracket 1 will grip legs 41 and cross piece 40 (collectively referred to as sawhorse members 39) in order to form a sawhorse configuration. Sawhorse bracket 1 will generally comprise three plates; first plate 2, second plate 4, and third plate 6. First plate 2 and second plate 4 act as side plates while third plate 6 acts as a bottom plate. As best seen in FIG. 2, all plates have an external surface 20 (facing away from sawhorse members 39) and an internal surface 19 (facing towards sawhorse members 39). First plate 2 and second plate 4 are substantially identical in shape except for being formed in opposite orientations such that first plate 2 is in effect the mirror image of second plate 4. Of course, some variation in shape between first plate 2 and second plate 4 would be within the scope of the present invention as long as the plates could function as described herein. Both first plate 2 and second plate 4 further comprise a top section 8 and a bottom section 9. Top section 8 and bottom section 9 are formed in nonparallel planes such that an obtuse angle $\alpha$ (alpha) is formed where top section 8 and bottom section 9 meet. In the embodiment shown, angle $\alpha$ is approximately 157.5°. In alternate embodiments, $\alpha$ typically may range from range from 150° to 175°. However, angles of less than 150° or more than 175° are intended to come within the scope of the present invention.

First plate 2 and second plate 4 will have upper apertures 12 and lower apertures 11, while plate 6 will have apertures 14. In the embodiment shown, apertures 11, 12, and 14 will combine with bolts 23 (seen in FIG. 1) to form a constrictive mechanism 22. The combination of apertures 11, 12, and 14 with bolts 23 is only one example of a constrictive mechanism 22 and constrictive mechanism 22 could include any other attachment means which would force plates 2, 4, and 6 together in order to grip a sawhorse member 39. For example, first plate 2 could be formed without apertures 11 and 12, but instead with threaded shafts extending from the interior surface 19 of first plate 2. The threaded shafts could engage plate 4 through upper apertures 12 and plate 6 through apertures 14. In such an embodiment, lower section 9 of plate 4 would also have threaded shafts extending to engage apertures 14. Another embodiment of constrictive mechanism 22 could comprise conventional clamps. Finally, the definition of constrictive mechanism is considered broad enough to include the apertures themselves without the interaction of bolts 23. Thus the plates as shown in FIG. 2 are considered to have constrictive mechanisms 22 attached thereto and these constrictive mechanisms may be then connected together by a bolt or any other conventional means.

Still viewing FIG. 2, third plate 6 comprises a top portion 17 and two downwardly extending sections 16. While the illustrated embodiment shows a plate 6 with top portion 17 and downwardly extending sections 16 integrally formed, the scope of the present invention includes embodiments where the two downwardly extending sections 16 are separate pieces. These separate pieces may or may not be connected along a top portion 17. Downwardly extending sections 16 are formed in nonparallel plains such that an acute angle β (beta) is formed therebetween with the apex of angle β corresponding with the top portion 17 of plate 6. In the embodiment shown, angle β is approximately 45°. In alternate embodiments, β typically may range from range from 30° to 60°. However, angles of less than 30° or more than 60° are intended to come within the scope of the present invention.

In operation, the plates 2, 4, and 6 of bracket 1 will be loosely joined by constrictive mechanisms 22. Sawhorse members 39 will then be inserted between plates 2, 4, and 6 as illustrated in FIG. 1. The distance between pairs of apertures 11 and pairs of apertures 14 will be sufficient to allow sawhorse legs 41 to be inserted therebetween. Furthermore, upper sections 8 of plates 2 and 4 will extend far enough above apertures 12 such that sawhorse cross piece 40 is securely gripped in the internal surface 19 extending above apertures 12 as seen in FIG. 1. When constrictive mechanisms 2, 4, and 6 are tightened, a highly rigid connection is formed between the three sawhorse members 39. This rigid connection is formed by the large surface area over which the outer skins of sawhorse members 39 are frictionally bound to interior surfaces 19 of plates 2, 4, and 6. It will be readily apparent that this connection allows rapid and easy replacement of any one of sawhorse members 39. Bolts 23 may be loosened, the damaged sawhorse member 39 removed, a new sawhorse member 39 inserted, and bolts 23 again tightened. This process is far more efficient than the prior art methods of completely removing the bolts and having to drill bolt apertures in the sawhorse member 39 before reassembling the sawhorse.

Furthermore, the design of the illustrated embodiment of bracket 1 makes the present invention far more economical to build than many prior art brackets. One preferred manufacturing process generally comprises cutting plate metal of the desired thickness into sections of predetermined and generally rectangular dimensions. For example, one embodiment could comprise 3/16" thick, AST AM36 steel plates cut to dimensions of approximately 5"×8". Of course, any suitable metal or other material could be utilized and the dimensions of the plates could vary considerably. Apertures may then be cut or punched in the plates. It will be understood that this preferred manufacturing process will construct all plates to the same dimensions and the apertures may be positioned in the same locations regardless of whether the plate will eventually be formed into a plate 2, 4, or 6. The manufacturing efficiency of only having to cut a single dimension of material for all plates 2, 4, or 6 will be readily apparent to those skilled in the art. The efficiency of the process is further increased by "gang punching" or simultaneously punching all four apertures in the plates.

Once the apertures are formed, the plates may be shaped into the proper configuration to form a plate 2, 4, or 6. This shaping process will typically be accomplish by cold bending of the plates, but could be accomplished by heating the plates before shaping or any other type of conventional metal working process.

Of course, the foregoing disclosure and description of the invention are only illustrative and explanatory thereof, and various changes in the size, shape and materials as well as in the details of the illustrated construction may be made without departing from the intended scope and spirit of the invention. For example, it is considered within the scope of the invention to cast plates in the desired shape rather than cold bending flat plates. Furthermore, it is envisioned that materials other than metals, such as high strength plastics now existing or to be developed in the future, may be used to construct the plates. All such variations are considered within the scope of the present invention as defined by the following claims.

I claim:

1. A sawhorse comprising:

a. a cross piece member;

b. a plurality of leg members, each of said leg members having a width; and c. a friction bracket comprising:

i. a first plate having upper and lower sections formed in two nonparallel planes. said lower section having first and second apertures spaced apart a distance greater than said width of said leg member;

ii. a second plate having upper and lower sections formed in two nonparallel planes, said lower section having first and second apertures spaced apart a distance greater than said width of said leg member and said upper sections of said first and second plate facing together and gripping said cross piece member; and iii. a third plate formed independently from said first plate and having a top portion and two downwardly extending sections formed in nonparallel planes and intersecting at said top portion, said downwardly extending sections having apertures formed thereon such that said apertures of said third plate are alignable with said apertures of said lower sections of said first and second plate when said third plate is positioned between said lower sections of said first and second plate, and iv. fastening devices passing through said apertures to clamp said leg members between said third plate and said lower sections, said fastening devices not penetrating said leg members.

2. A sawhorse according to claim 1, wherein said fastening devices comprise bolts.

3. A sawhorse according to claim 1, wherein said cross piece has two ends with a friction bracket positioned proximate each of said ends.

4. A sawhorse according to claim 1, wherein an aperture is formed in said upper section of said first and second plates.

* * * * *